US005435410A

United States Patent [19]

Langston

[11] Patent Number: 5,435,410

[45] Date of Patent: Jul. 25, 1995

[54] BRIDGE SIDEWALK VEHICLE

[76] Inventor: Ralph C. Langston, 13588 SE. 152nd Ave., Clackamas, Oreg. 97015

[21] Appl. No.: 95,606

[22] Filed: Jul. 21, 1993

[51] Int. Cl.[6] ..... B66F 11/04

[52] U.S. Cl. ..... 182/63; 182/2

[58] Field of Search ..... 182/2, 63, 141

[56] References Cited

U.S. PATENT DOCUMENTS

| | | | |
|---|---|---|---|
| 3,262,517 | 7/1966 | Malec | 182/2 |
| 4,154,318 | 5/1979 | Malleone | 182/63 |
| 4,569,416 | 2/1986 | Stokoe | 182/2 |
| 4,646,875 | 3/1987 | Sholl | 182/2 |
| 4,696,371 | 9/1987 | Moog | 182/63 |
| 5,297,653 | 3/1994 | Wurtz | 182/141 X |

FOREIGN PATENT DOCUMENTS

| | | | |
|---|---|---|---|
| 2650815 | 2/1991 | France | 182/2 |

*Primary Examiner*—Alvin C. Chin-Shue

*Attorney, Agent, or Firm*—Marger, Johnson, McCollom & Stolowitz

[57] ABSTRACT

A mobile boom vehicle includes a boom assembly that supports and shifts equipment and personnel over a bridge. The boom assembly is coupled to the top of a frame that is sized to operate entirely within the width of a sidewalk. The mobile boom vehicle can, therefore, operate on a sidewalk bridge without obstructing bridge vehicular traffic. Outriggers are coupled to the frame and are capable of extending either over the top of a guardrail or horizontally from the top of the frame. A drive wheel is centered behind the rear end of the frame and lifts part of the frame off the bridge before moving the frame along the bridge. A pair of detachable guide wheels are extendable down below the frame at various distances for holding the mobile boom vehicle in a level position when the frame extends over the edge of a sidewalk. Two mobile boom vehicles can be located on an opposite sides of the bridge for support a basket that spans underneath the bridge.

4 Claims, 7 Drawing Sheets

BRIDGE SIDEWALK VEHICLE

BACKGROUND OF THE INVENTION

This invention relates generally to supporting and transporting equipment and personnel on an elevated structure and more particularly to a lightweight mobile boom vehicle that operates in a narrow space such as along a bridge sidewalk.

It is often necessary to transport or support equipment and people over the edge of an elevated structure such as a bridge, oil rig, or ship. For example, it is often necessary to paint, inspect, hang conduit or work on structural components on the side or underneath a bridge. To support the equipment and workmen that must to be transported over the bridge, a basket is typically attached to the end of a crane or boom, or hung from ropes. The basket is placed on top of the bridge where it is loaded with the equipment and workman and then lowered over the side of the bridge to the location where the work must be performed. After the work has been completed in the present location, the basket is raised and the basket supports (e.g., ropes) are positioned in a second location. The basket is then reloaded with the equipment and workmen and then re-lowered over the side of the bridge. This process is repeated at each location along the bridge where work is preformed.

It is time consuming to raise and lower the basket each time it is repositioned, especially if work must be performed on many different areas. For example, if the entire bridge must be painted or if cable must be spanned underneath the bridge, then the basket must be repositioned many times during the job. It often can take more time to raise, reposition, and lower the basket than to actually perform the work at the location where the basket is lowered. Because many personnel, including the workers in the basket, support personnel, and traffic controllers are needed when the bridge work is being performed, the cost of completing the job increases proportionally with the time required to complete the work. In addition, with each raising and lowering of the basket, the chances of a dangerous mishap increase.

To reduce the amount of time required to complete the jobs performed on the sides and underneath elevated structures, trucks with attached boom assemblies are used to transport and support baskets over the side of the structure. The truck is positioned at some location, for example, in the roadway on a bridge. The boom assembly on top of the truck then raises and lowers a basket over the side of the bridge. When work is completed at the present location, the basket and boom are raised and the truck is then moved further down the road to a new bridge location. Thus, the boom truck eliminates having to untie and retie ropes at each new location on the bridge.

While boom trucks can reduce the time required to complete a bridge project, they also require a large amount of space and, therefore, cause congestion on bridge roadways. For example, when in use, a boom truck blocks at least one lane of traffic on the bridge roadway, increasing traffic congestion, and the risk of traffic accidents. Boom trucks also require flagmen to redirect traffic, further increasing the cost of performing the project.

Boom trucks also have a limited range of locations where they can position a basket. This is because the boom truck is relatively wide and, therefore, must be positioned on the roadway far from the side of the bridge. The boom assembly on top of the boom truck is then limited in the range of angles at which it can be directed over the side and underneath the bridge. In addition, because the truck is positioned on the bridge roadway, long boom members are needed to extend over the side of the bridge. Long boom members increase the amount of torque exerted on the boom truck when supporting equipment and workmen. Therefore, the boom truck must be heavy enough to prevent being tipped over. A heavy boom truck, however, cannot be driven on bridges with limited load capacity. In addition, longer boom assemblies are more expensive and also increase overall truck weight.

Stability can be increased by attaching outriggers on the outside of the boom truck. Typically, outriggers are hydraulically controlled and extend out the lateral sides of the truck to provide a wider truck base. The end of each outrigger has a fiat plate that presses on top of the bridge structure, holding the boom truck firmly in one location. Outriggers, however, by extending laterally out the sides of the boom truck, expand the area required for the truck to operate. An expanded boom truck operating area further obstructs traffic and limits the number of locations the truck can access. In addition, the metal plates on the bottom of each outrigger must be lifted off the ground and then reseated on the ground each time the boom truck is moved to a new location. Therefore, additional setup time is required each time the boom truck is moved.

It is often not possible for a boom truck to move next to the edge of an elevated structure. For example, a bridge often has railroad tracks or a sidewalk that runs along the outside edge. If a sidewalk runs along the side of the bridge, there are usually handrails or fencing on either side of the sidewalk that are too closely spaced together for a boom truck to fit. Even if a handrail did not exist, the sidewalk is typically elevated from the rest of the bridge roadway. Since the boom truck would then sit in an unstable non-level position, it is not possible for two wheels of the boom truck to ride on the sidewalk and the other two wheels to ride on the roadway.

Accordingly, a need remains for a small lightweight boom that is easily to move and that supports heavy loads in a wide variety of positions over the side of a bridge or other elevated structure.

SUMMARY OF THE INVENTION

It is, therefore, an object of the invention to reduce the size and weight of mobile boom vehicle assemblies.

Another object of the invention is to increase the range of accessible locations in which a boom assembly can be positioned over the side and below an elevated structure while maintaining a high degree of stability.

Still another object of the invention is to perform work on the sides and underneath a bridge without obstructing traffic on top of the bridge.

A further object of the invention is to reduce the time required to move equipment and personnel between different locations over the side of an elevated structure.

The invention is a mobile boom vehicle that transports equipment and personnel over the side and underneath a bridge or other elevated structure. The mobile boom vehicle is narrow enough to operate within a very small area, for example, on a bridge sidewalk. Therefore, construction and maintenance operations can be performed without obstructing traffic or any other operation that may be occurring on the bridge or elevated structure. The mobile boom vehicle is also lightweight, and, therefore, can operate on structures with low load ratings. This vehicle allows the boom to access many structures not normally capable of supporting mobile boom assemblies.

Although the mobile boom vehicle is small, it provides sufficient stability to support loads typically carried by much larger boom assemblies. To provide additional stability, a novel outrigger configuration can be used to ensure that the mobile boom vehicle stays in an upright position even when supporting heavy loads. The outrigger is operated in various configurations that can either lean against existing structures on the bridge or stand alone. The outrigger is also configured to operate in a minimal amount of space, allowing the mobile boom vehicle to still operate in a narrow operating area, for example, on a sidewalk.

Because the mobile boom vehicle is relatively small, it can be placed very close to the edge of a bridge. This allows the mobile boom vehicle to access a wider range of locations on the side and underneath the bridge than is presently possible with traditional boom assemblies. In addition, because the mobile boom vehicle is placed closer to the bridge edge, loads supported underneath the bridge are more likely to reside directly under the mobile boom vehicle structure. This increases boom stability since the force of the load is directed down immediately below the boom, rather than off to the side where the boom assembly is more likely to tip over.

The mobile boom vehicle preferably has a novel wheel system that allows the system to be moved along the sidewalk while at the same time safely supporting a load over the edge of the bridge. Support wheels are raised off the bridge when the mobile boom vehicle is relocated and then lowered when the boom is to remain stationary in one location. A raisable and steerable drive wheel controls the vertical movement of the support wheels while at the same time providing drive and direction for the boom. A detachable guide wheel system enables the boom to remain level even if operating on a multi-level surface. The guide wheels allow the boom to move while operating on the multi-level surface and also provide additional counter-weight to maintain the mobile boom vehicle in a stable upright position.

Preferably, the mobile boom vehicle comprises a frame having a first and second pair of horizontally aligned side members joined together by a front and back pair of traverse cross-members that determine the width of the frame. A platform is pivotally joined to the top of the frame and rotates radially about a vertically directed center line. A boom assembly is coupled to the rotating platform and supports and shifts equipment and personnel over and below the elevated structure.

The frame width is sized to be less than the width of a sidewalk that typically extends along the elevated structure. Thus, the boom has the capability of operating completely within the area of the sidewalk without obstructing areas adjacent to the sidewalk, such as an automobile roadway. Therefore, traffic congestion is eliminated and special flagmen do not have to be employed to redirect traffic.

In one embodiment, two outriggers each comprising a single arm, are pivotally coupled to the frame and are capable of extending over and onto the top of a guardrail extending along the side of the elevated structure. Each outrigger rotates out laterally from the top of the frame, thereby providing additional support in holding the frame in an upright position while at the same time minimizing the width required for the outrigger to operate.

In another embodiment, the outrigger includes a detachable leg that is hinged to the end of the outrigger arm. The leg extends into a vertical position as the arm extends horizontally out from the top of the frame, holding the arm in a horizontal position above the bridge and, thereby, supporting the frame in an upright position.

Wheels can be located underneath each outrigger leg, allowing the outriggers to be moved while still supporting the frame. Because the mobile boom vehicle can move to various locations along the structure without having to lift and reseat the outriggers, work on the bridge can be completed in a shorter amount of time.

Support wheels are mounted underneath the frame so that they can roll only along a straight line parallel with the side of the frame. With this limited range of movement, the support wheels keep the frame in a stable position as the boom assembly operates over and below the elevated structure while at the same time allowing the frame to be moved to different locations along the elevated structure.

A steerable drive wheel is centered behind the rear end of the frame and controls which direction the crane moves along the bridge. The drive wheel can be raised and lowered in various vertical positions, thereby, raising the support wheels on the back of the frame in the air. While the support wheels are lifted in the air, the drive wheel controls the speed and direction in which the mobile boom vehicle moves.

A pair of detachable guide wheels are each joined to one side of the frame and are extendable down below the frame at an adjustable elevation. The guide wheels hold the boom in a level position when the frame extends over a bi-level surface such as over the curb of a sidewalk. Each guide wheel includes an associated guide wheel arm that is pivotally coupled at a pivot point to the side of the frame. A lower end of the arm is joined to the associated guide wheel and a top end has a hole that is aligned with different holes that are positioned radially about the arm pivot point. The guide wheel is positioned at various distances below the frame by rotating the arm about the pivot point. The hole in the guide wheel arm is then aligned with the closest hole on the side of the frame. A bolt is then inserted into the aligned holes, holding the guide wheel at a given distance below the frame. Thus, the frame remains level even when being moved over bi-level surfaces.

An alternative method for supporting loads underneath the bridge utilizes two mobile boom vehicles each located on an opposite side of the bridge. A basket is located underneath the bridge and suspended at opposite ends between the two booms. The mobile boom vehicles are moved in the same direction up and down the bridge, thereby, moving the basket to different locations while keeping the basket from skewing. Because each mobile boom vehicle is operated at opposite edges of the bridge, there is no obstruction on the bridge roadway and since two booms are utilized, a heavier load can be supported underneath the bridge.

Since the mobile boom vehicle is small and lightweight it can be utilized on structures not normally accessible by larger, heavier structures. However, due to a unique design the boom provides superior stability and load support not normally obtainable with structures of equivalent size. In addition, by being able to safely move the mobile boom vehicle while still carrying a load, the invention can move equipment and people to various locations on an elevated structure in a shorter amount of time.

Another advantage is that the mobile boom vehicle can operate on bridge sidewalks that are supported outboard of the bridge superstructure and, therefore, can be used where truck booms cannot be used.

The foregoing and other objects, features and advantages of the invention will become more readily apparent from the following detailed description of a preferred embodiment of the invention which proceeds with reference to the accompanying drawings.

DETAILED DESCRIPTION

Figure 1:
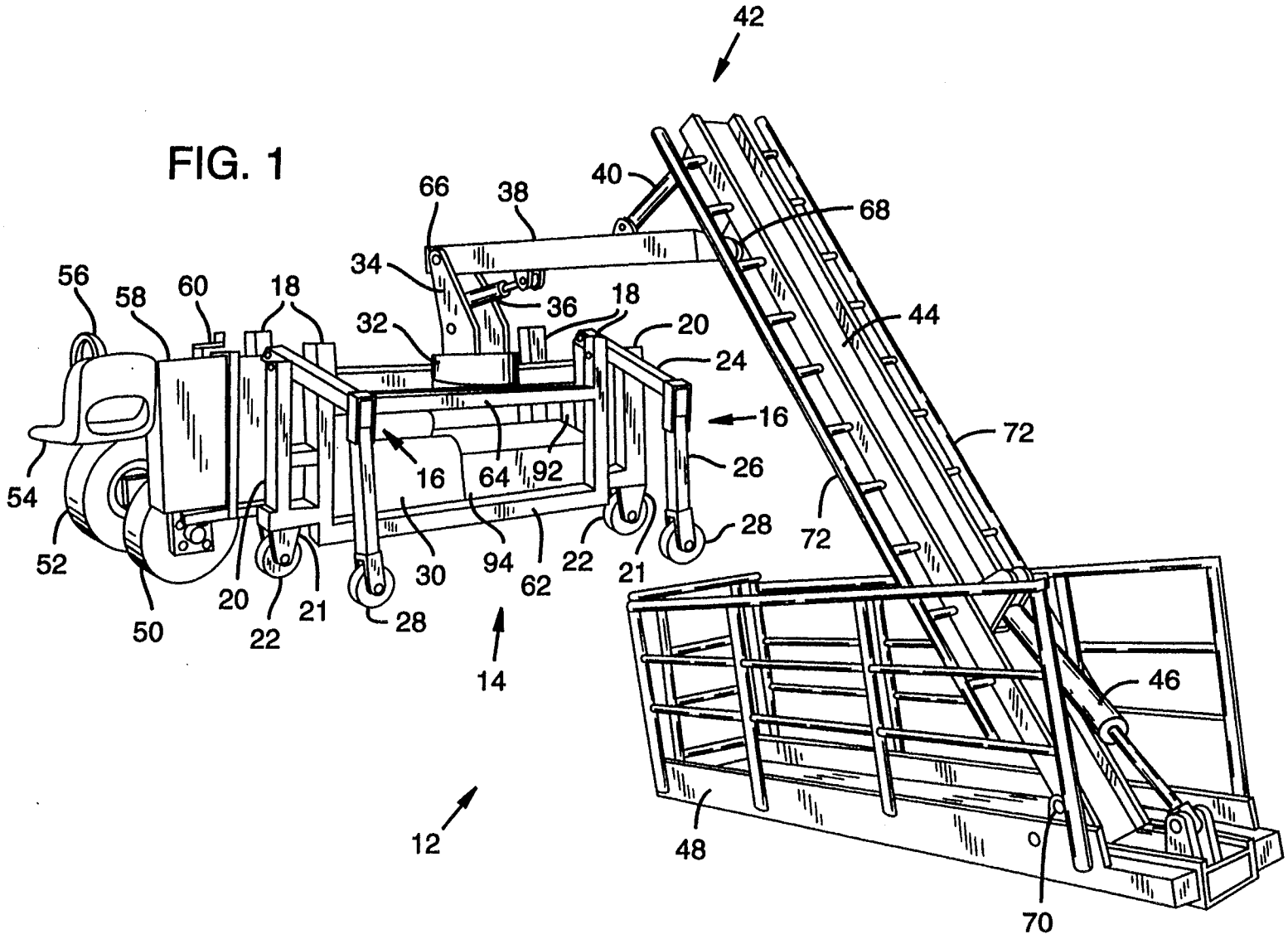
FIG. 1 is a perspective view of a mobile boom vehicle according to the invention.

FIG. 1 is an outboard perspective view of a mobile boom vehicle 12 according to the invention. A boom assembly 42 is supported on top of a frame 14 by a hydraulically driven rotatable platform 32. Movement of the boom assembly 42 is controlled by a series of rams 36, 40 and 46 that are controlled hydraulically via a hydraulic pump 16 manufactured by Onan Inc., using fluid supplied by a hydraulic reservoir 30. Hydraulic control of a boom is well known to those skilled in the art and, therefore, the details of how boom assembly 42 is controlled are not described in detail. A drive wheel 50 is centered at a front end of frame 14 and is directionally controlled by steering wheel 56 and by a crank 60. A tank 58 is attached between a chair 54 and the front end of frame 14. A storage box 94 resides within frame 14.

The frame has two sides that each include a top horizontal member 64 and a bottom horizontal member 62 that are joined together at a front and back end by vertically aligned corner members 18. Top and bottom transverse cross-members 90 (see FIGS. 2 and 3) interconnect the two sides of frame 14 at both the front and back ends. The corners of frame 14 each have an extension member 20, aligned parallel with an associated corner member 18 and spaced fore and aft of the front and back corner members of each side of frame 14. The frame also includes support wheels 22 that are each attached underneath an associated extension member 20 by a caster 21 to roll in a direction parallel to the sides of frame 14.

A pair of outriggers 16 are pivotally attached on one side of frame 14 between the corner member 18 and the associated extension member 20. Each outrigger 16 includes an arm 24 pivotally attached at an outboard end to a leg 26. A wheel 28 is coupled to the bottom of each outrigger leg 26 and is aligned to roll in a direction parallel with the side of frame 14.

The boom assembly 42 includes a support 34 coupled to rotatable platform 32. A boom 38 is coupled at a first end at a pivot 66 and by ram 36 to support 34 and is coupled at a second end at a pivot 68 and by ram 40 to a first end of boom arm 44. The second end of boom arm 44 is coupled to a basket 48 at pivot 70 and by ram 46. A ladder 72 is attached on opposite lateral sides of boom arm 44. The size of boom 38, boom arm 44, and basket 48 can be altered for various applications. For example, boom 38 can be lengthened to allow further horizontal displacement of boom arm 44 over the side of an elevated structure. Alternatively, the pivot points between boom 38 and boom arm 44 can be adjusted as will be described further in FIG. 2. It is possible to control the movement of the boom assembly 42 hydraulically either from a control panel on frame 14 or from basket 48.

Rotatable platform 32 moves the boom assembly 42 at any angle within a 360 degree horizontal plane. Ram 36 alters the angle of boom 38; ram 40 alters the angle of boom arm 44; and ram 46 alters the angle of basket 48 all along the same vertical plane. Thus, the boom assembly 42 can extend out from and underneath frame 14 at a wide arrangement of different angles. While the boom configuration shown in FIG. 1 is a preferred embodiment, alternative boom configurations would be easily attached to the top of frame 14.

Figure 2:
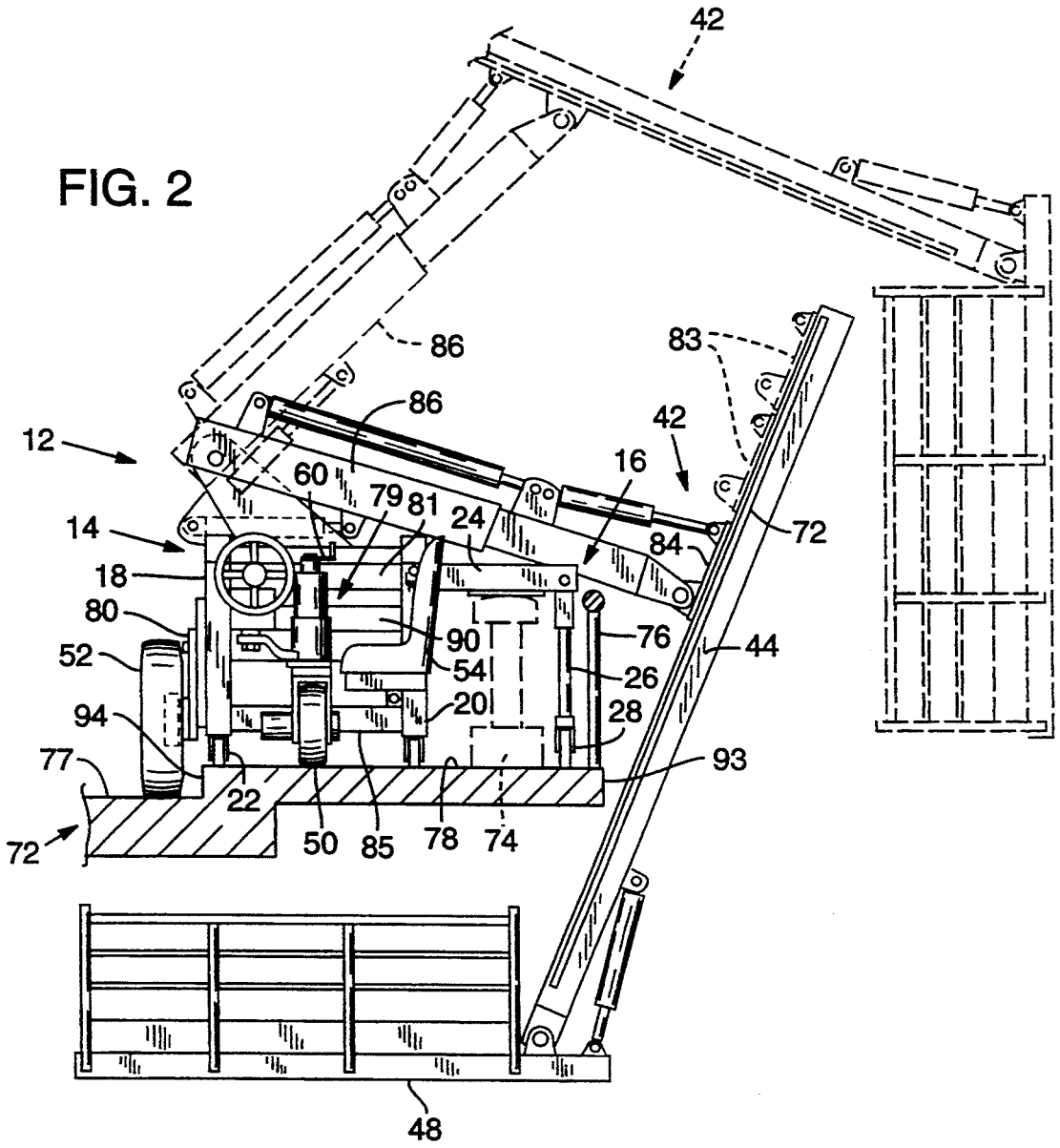
FIG. 2 is a front end elevation view of the mobile boom vehicle of FIG. 1 located on a bridge shown in cross-section.
Figure 3:
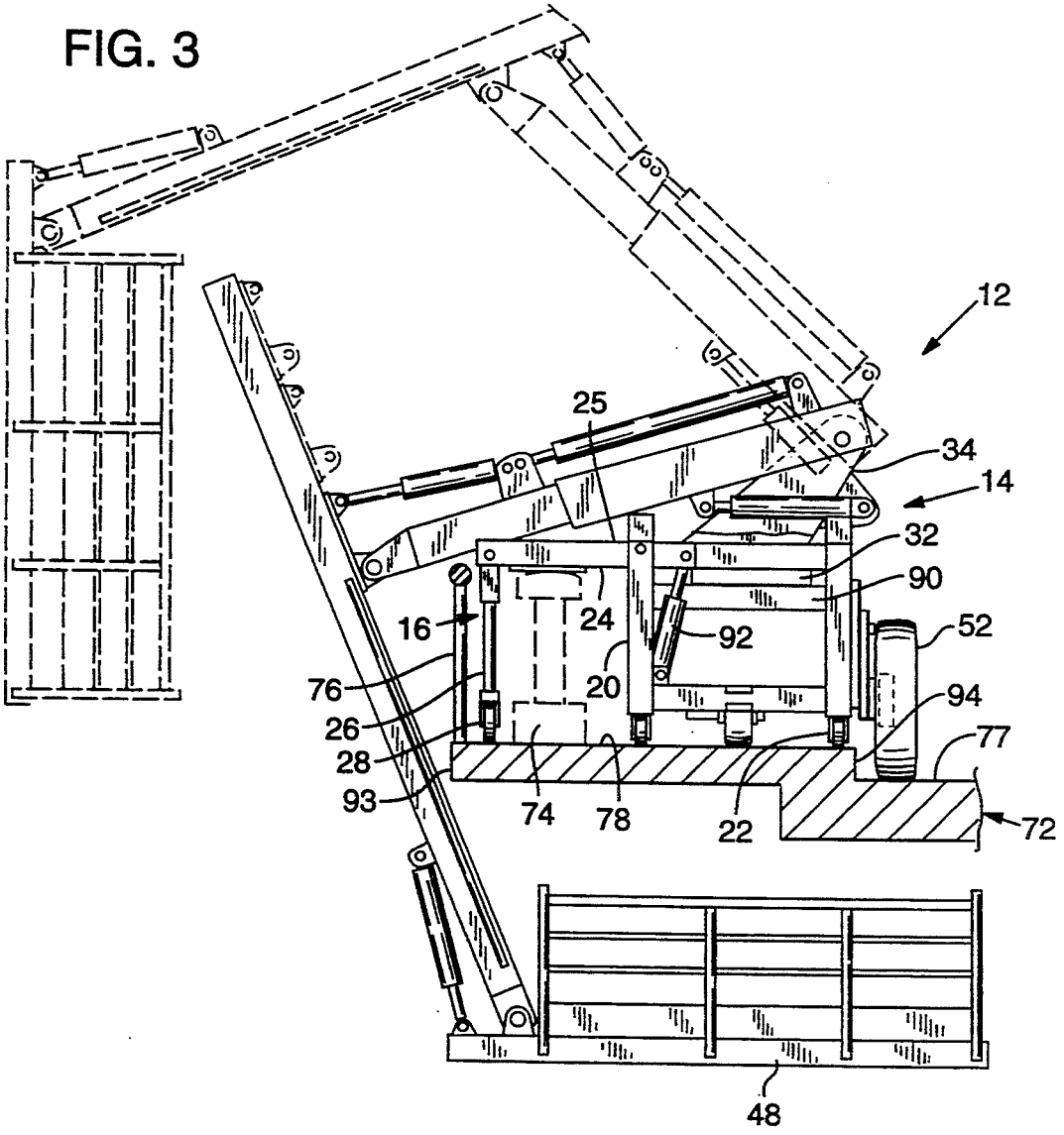
FIG. 3 is a rear end elevation view of the mobile boom vehicle of FIG. 1 located on a bridge shown in cross-section.

FIG. 2 is a front elevation view and FIG. 3 is a rear elevation view of the mobile boom vehicle 12 shown in FIG. 1. The mobile boom vehicle 12 is shown located on a bridge 72 shown in cross-section. Bridge 72 is one example of an elevated structure in which mobile boom vehicle 12 can be used to support and transport equipment and personnel. Mobile boom vehicle 12 is equally as effective for use on alternative elevated structures such as ships, oil rigs, train tressels, etc. The bridge 72 comprises a roadway 77 where cars, trucks, and other vehicles are driven over the bridge. As is typical with many bridges, an elevated sidewalk 78 is located on at least one lateral side of bridge 72. Along the side 93 of the bridge 72 is a vertically aligned guardrail, which is depicted in FIG. 2 with two alternative structures as either guardrail 76 shown in solid lines or guardrail 74 shown in dashed lines.

An upper front cross-member 81 and a lower front cross-member 85 join the sides of frame 14 together. A support plate 90 is used to hold rotatable platform 32 (FIG. 1). FIGS. 2 and 3 also show another embodiment of boom assembly 42 with an extendable boom 86 replacing fixed boom 38. Multiple mounting holes are located at the top end of boom arm 44 and receive a base plate 84. The base plate allows the top end of boom 86 to be coupled at various locations to boom arm 44. The boom assembly 42 is shown in a raised position in dashed lines and in a lowered position underneath bridge 72 and directly below frame 14 in solid lines.

Figure 5:
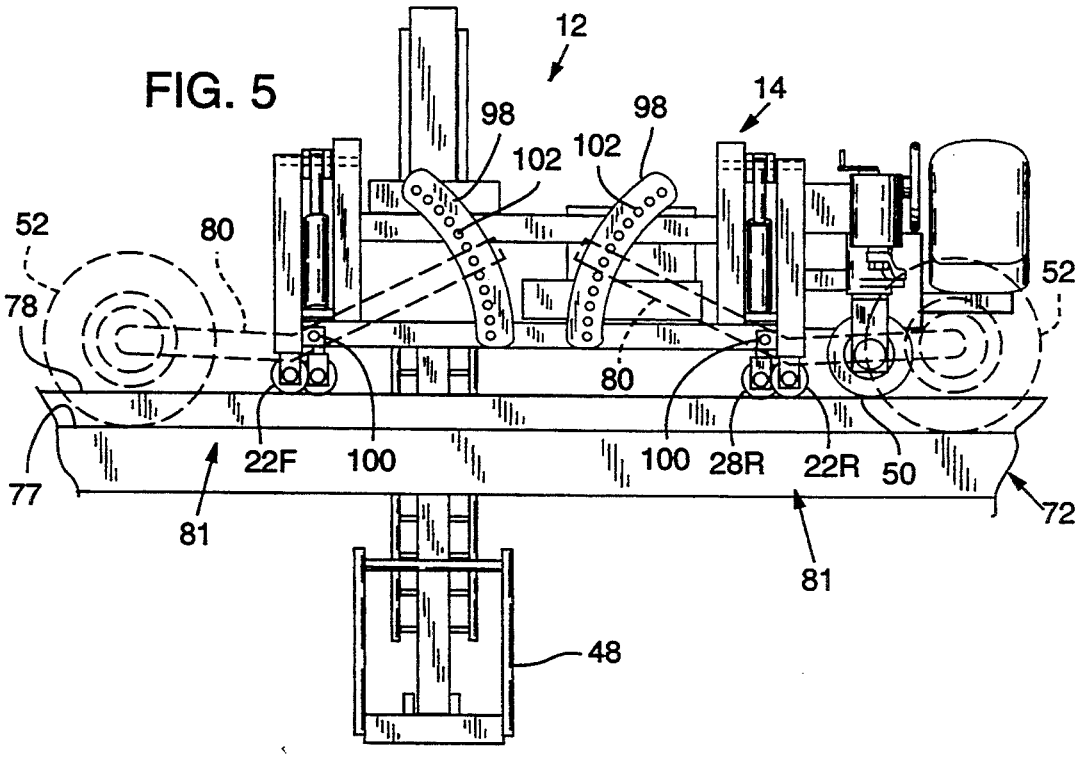
FIG. 5 is a left or inboard side elevation view of the mobile boom vehicle of FIG. 1.

Guide wheel 52 is joined to the inboard side of frame 14 by a guide wheel arm 80 and is shown in further detail in FIG. 5. Drive wheel assembly 79 is shown in further detail in FIG. 7.

It can be seen that the width of frame 14 (e.g., the distance between the sides of frame 14) is less that the width of sidewalk 78 (i.e., the distance from guardrail 74 to the curb 94). Therefore, the mobile boom vehicle 12 operates completely within the area defined by the outer lateral sides of sidewalk 78. By being able to support frame 14 completely on sidewalk 78, the mobile boom vehicle 12 can operate without obstructing traffic on roadway 77. This arrangement prevents traffic jams and reduces the number of people required to redirect traffic.

Because the mobile boom vehicle 12 is relatively small, it can operate relatively close to the side 93 of bridge 72. Therefore, boom 86 on boom assembly 42 does not have to be as long as typical truck mounted booms. For example, a truck boom is too wide to sit completely on sidewalk 78 and, therefore, must operate from roadway 77. A boom on the truck must, therefore, extend from roadway 77 over bridge side 93. However, boom 86 on mobile boom vehicle 12 can be shorter since frame 14 is already positioned on sidewalk 78. A shorter boom reduces manufacturing costs of the boom assembly 42 and reduces the overall boom assembly weight. It is also easier for a boom operator to observe the actions of personnel in basket 48 when frame 14 is located on sidewalk 78 eliminating the need for an extra watchman.

In addition, by moving the mobile boom vehicle 12 closer to the side 93 of the bridge 72, the boom assembly 42 can reach further underneath bridge 72. This allows more areas of bridge 72 to be accessible to boom assembly 42 than would typically be possible if the boom assembly were mounted on a truck. When basket 48 is underneath frame 14, as shown in solid lines in FIGS. 2 and 3, the weight of a load in basket 48 is transferred from the boom assembly 42 straight down on top of frame 14. Because the force from a load in basket 48 is directly underneath frame 14, the stability of frame 14 is greater than other boom structures.

For example, if a boom truck were too large to operate on sidewalk 78, it would then have to operate from road 77. With the boom operating further from the side 93 of bridge 72, it is more likely that basket 48 will not operate directly below the boom truck but at some distance off to the side of the boom truck. The weight in basket 48 will, therefore, exert a lateral force on the boom truck that has more tendency to tip the truck over. However, frame 14 operates close to the side 73 of bridge 72. Therefore, more downward vertical force is exerted on frame 14 which does not tend to tip frame 14 but alternatively holds frame 14 more securely to the surface of bridge 72.

The extendable boom 86 allows easy loading of people and equipment into basket 48. For example, basket 48 can be located along the side 93 of bridge 72 in an intermediate position not shown in FIG. 2. The basket 48 can then be loaded safely before boom 86 is extended and dropped further down underneath bridge 72. Extendable boom 86 also increases the number of locations that basket 48 can access bridge 72. To further increase the distance that basket 48 extends below or underneath bridge 77, boom 86 can be joined at different locations at the top end of boom arm 44. For example, plate 84 can be bolted further up at the top of boom arm 44 as shown in dashed line 83. Boom 44 is then effectively longer and can extend further underneath the bridge 72.

Referring to FIG. 3, outriggers 16 increase the stability of the mobile boom vehicle 12 by providing additional support for frame 14 while still operating within the confines of the sidewalk 78. For example, ram 92 is coupled to a first end of outrigger arm 24. Arm 24 is pivotally coupled off center between extension member 20 and corner member 18 (not shown) at pivot point 25. Therefore, when ram 92 retract and expands, arm 24 rotates about pivot point 25 180 degrees swinging out from the top of frame 14 and over the top of guardrail 74. Arm 24, thus, provides additional support in holding the frame 14 in an upright position.

Because arm 24 seats over guard rail 74, it does not require additional space in front of the guardrail. Thus, frame 14 can be placed closer to vertically extended structures such as guardrail 74 without obstructing outrigger extension. Outriggers 16 do not significantly increase boom operating space while adding significantly adding stability to frame 14. In addition, arm 24 is attached to the top of frame 14 and is supported in a substantially horizontal position on guard rail 74. The horizontally supported outrigger arm 24 provides greater stability for frame 14 than standard outrigger arms that extend diagonally down from the side of a truck onto a road surface.

A detachable leg 26 is pivotally coupled to a second end of arm 24 and extends vertically downward as arm 24 extends out from frame 14 into a horizontal position. Leg 26 holds the arm 24 above the bridge and helps support frame 14 in an upright position without the assistance of guardrail 74. Leg 26 is used when arm 24 cannot be rotated onto a vertical structure already extending up from the side of bridge 72. For example, a handrail 76 may not be strong enough to effectively support frame 14 or alternatively there may be a fence that extends up from the top of handrail 76 that prevents outrigger arm 24 from being moved over the top of the handrail. Alternatively, there may not be a handrail that extends along the edge of the elevated structure. Therefore, leg 26 can be attached to arm 24 so that outrigger 16 can provide stand-alone support for frame 14.

In many situations, sidewalk 78 is wide enough to contain both the frame 14 and the extended outrigger 16. Therefore, leg 26 is attached to arm 24 and used for supporting frame 14 regardless of whether a guardrail exists on the bridge. Outrigger wheels 28 allow frame 14 to be moved along the bridge 72 while the outrigger 16 remains in the extended position shown in FIGS. 2 and 3. Thus, the outrigger supports the frame while it is being moved to different locations on the bridge. This, minimizes boom set-up time since the outriggers do not have to be raised and lowered each time the boom is moved to a different location.

Guide wheel 52 keeps the mobile boom vehicle 12 in an upright position when frame 14 extends over curb 94. For example, if sidewalk 78 is narrower than the width of frame 14, the mobile boom vehicle can still operate partially on top of the sidewalk, thereby, maintaining close proximity to the edge 93 of the bridge. Alternatively, if the mobile boom vehicle must navigate around an obstruction on the sidewalk, for example, a road sign, it may require that the inboard side of frame 14 to temporarily extend out over the curb 94.

In either of the above situations, if guide wheels 52 were not installed, the inboard support wheels 22 would extend over the curb 94 causing frame 14 to tilt or fall onto roadway 77. However, with guide wheels 52 installed, as the support wheels 22 start to move over curb 94, the guide wheels 52 hold the frame 14 in a level upright position. As the inboard support wheels 22 then move back onto sidewalk 78, much of the weight from frame 14 is transferred from guide wheels 52 back to the outside support wheels 22. It is important to note that the guide wheels 52 support frame 14 even while frame 14 is being moved. Therefore, the load in basket 48 does not have to be removed before extending the frame 14 over curb 94 of sidewalk 78. This further reduces the amount of time required to move the equipment and personnel to different locations on bridge 72.

Figure 4:
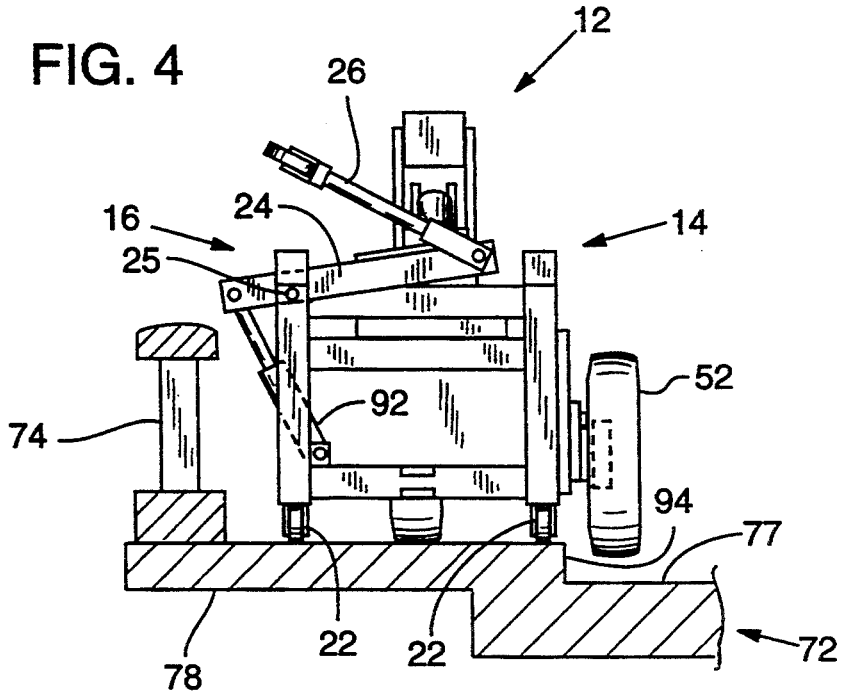
FIG. 4 is a partial elevation view of the mobile boom vehicle of FIG. 3 shown with retracted outriggers and guide wheels.

FIG. 4 is a partial elevation view of the mobile boom vehicle 12 of FIG. 1 shown with retracted outriggers 16 and retracted guide wheels 52. If frame 14 does not or will not extend over the curb 94, guide wheel 52 can be either removed or lifted up above the roadway 77 as will be described in further detail in FIG. 5.

To move outrigger 16 from the extended position previously shown in FIG. 3 into the contracted position shown in FIG. 4, ram 92 is hydraulically contracted forcing arm 24 to rotate radially about pivot point 25 in a clock-wise manner. As arm 24 rotates back toward frame 14, arm 24 folds down on top of leg 26. After ram 92 reaches a fully contracted position, ram 92 is then expanded causing arm 24 to rotate further up over pivot point 25 and on top of frame 14 into the position shown in FIG. 4.

To extend arm 24 out from the top of frame 14, ram 92 is first compressed causing arm 24 to begin rotating counter-clockwise up from the top of frame 14. As arm 24 rotates about pivot point 25 it eventually reaches a vertical position aligned with pivot point 25. Because the arm 24 is off-center, after the arm passes over pivot point 25, the weight of the arm 24 pulls it further downward in a counter-clockwise rotation, Arm 24 rotates down ward until it rests on top of a guardrail 74 or, if guardrail 74 is not present, until leg 26 extends down into a vertical position.

FIG. 5 is a left or inboard side elevation view of mobile boom vehicle 12 of FIG. 1 with drive wheel 50 in a raised position and guide wheels 52 in lowered positions. In the raised drive wheel position, drive wheel 50 extends down below frame 14 at substantially the same distance as rear support wheels 22R and rear outrigger wheel 28R. Because, the support wheels 22 are locked in a common direction parallel with the sides of frame 14, the support wheels 22 do not roll when a load in basket 48 directs a force laterally from the side of frame 14. Thus, the support wheels while capable of moving down the bridge 72, provide a stable platform for frame 14 when holding loads over the side of bridge 72.

Two guide wheel assemblies 81 are shown in dashed lines to indicate that they are detachable. Each guide wheel assembly includes a guide wheel arm 80 coupled at a pivot point 100 to the side of the frame 14. A bottom end of guide wheel arm 80 is joined to the guide wheel 52 and a top end contains holes that align with the holes 102 located in a rack 98. The holes in rack 98 are positioned to extend radially about the associated pivot point 100. Thus, the guide wheel 52 can be positioned at various distances below frame 14 by rotating the guide wheel arm 80 about the pivot point 100 until the hole at the top end of arm 80 aligns coaxially with the desired hole 102 in rack 98. A bolt (not shown) is then inserted in the coaxially aligned holes locking arm 80 TO RACK 98.

The guide wheels can be raised or lowered depending upon how high sidewalk 78 extends over roadway 77. For example, if sidewalk 78 extends higher above roadway 77 than as shown in FIG. 5, each guide wheel arm 80 could be moved from the present hole in rack 98 and rotated upward until the guide wheels 52 made contact with the top of roadway 77. The hole in the top end of guide wheel arm 80 is then aligned and bolted with the closest hole in rack 98.

Correspondingly, if the top of sidewalk 78 is lower than what is shown in FIG. 5, each guide wheel arm 80 is rotated downward causing the guide wheels 52 to rise. The guide wheels are lifted until the support wheels 22 make contact with the top of sidewalk 78 ensuring that frame 14 is level. Thus, if frame 14 extends over the curb of side walk 78, guide wheels 52 keep frame 14 level. Guide wheels 52 can be used for any application where the mobile boom vehicle must operate on a non-level surface. For example, on an inclined surface or on any multi-level surface that the frame 14 must cross over. The guide wheel assemblies 81 also provide addition counter-weight to frame 14.

Figure 6:
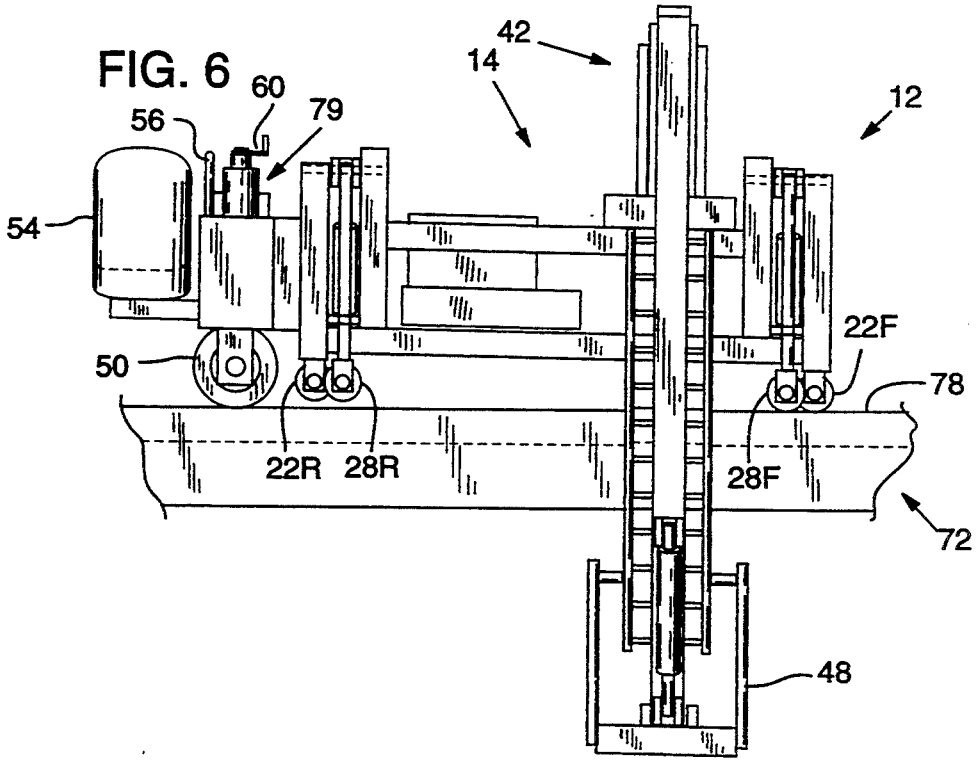
FIG. 6 is a right or outboard side elevation view of the mobile boom vehicle of FIG. 1 shown in a lowered drive wheel position.

FIG. 6 is a outboard side elevation view of the mobile boom vehicle 12 shown in FIG. I with the drive wheel 50 in a lowered position. Crank 60 of drive wheel assembly 79 controls how far drive wheel 50 extends down below frame 14. By turning crank 60 the drive wheel extends lower than the rear support wheels 22R and the rear outrigger wheel 28R. In the lowered drive wheel position, the frame 14 operates essentially as a tricycle with the two front support wheels 22F supporting the front of frame 14 and the drive wheel 50 supporting the back of frame 14. The direction of drive wheel 50 is then varied by turning steering wheel 56. Drive wheel 50 is hydraulically driven causing frame 14 to move according to the direction of the drive wheel 50.

It is important to note that the rear support wheels 22R and the rear outrigger wheel 28R are only slightly raised above the surface of sidewalk 78. Thus, while in the lowered drive wheel position shown in FIG. 6, the rear support wheels 22R and the outrigger wheels 28R provide additional support in case the frame 14 tilts too much to either side. Since the mobile boom vehicle 12 remains in a highly stable condition in the raised drive wheel position, a load can remain in basket 48 even while the frame 14 is being moved to different locations on bridge 72. Drive wheel 50 is turned at a wide range of angles allowing the mobile boom vehicle to navigate around tight corners such as around a lighting standard.

Drive wheel 50 has the added advantage of being raised and lowered by crank 60 to more than one position. Therefore, the drive wheel can be set just slightly lower than the rear support wheels 22R while supporting a load. This allows support wheels 22R to provide maximum support for the frame 14 when boom assembly 42 is loaded. However, when the mobile boom vehicle is simply being transported between different location, for example, from a truck to the intended work site, then the drive wheel 50 can be lowered even further to navigate over curbs or other obstructions. The drive wheel is centered at the back end of frame 14 between the two frame sides to balance the front end of frame 14 above the bridge.

Drive wheel 50 also maximizes the potential turning ratio of frame 14. For example, a single drive wheel 50 both can be turned in a greater variety of directions than two drive wheels coupled together by an axle. In addition, since only one drive wheel is used, the cost of manufacturing the drive wheel assembly is reduced. Thus, drive wheel 50 lifts the frame 14 in different vertical positions and drives the frame in various horizontal directions. The drive wheel 50 is typically an inflatable rubber tire, however, any alternative tire material that has a high load capability can also be utilized, such as a solid rubber tire.

Figure 7:
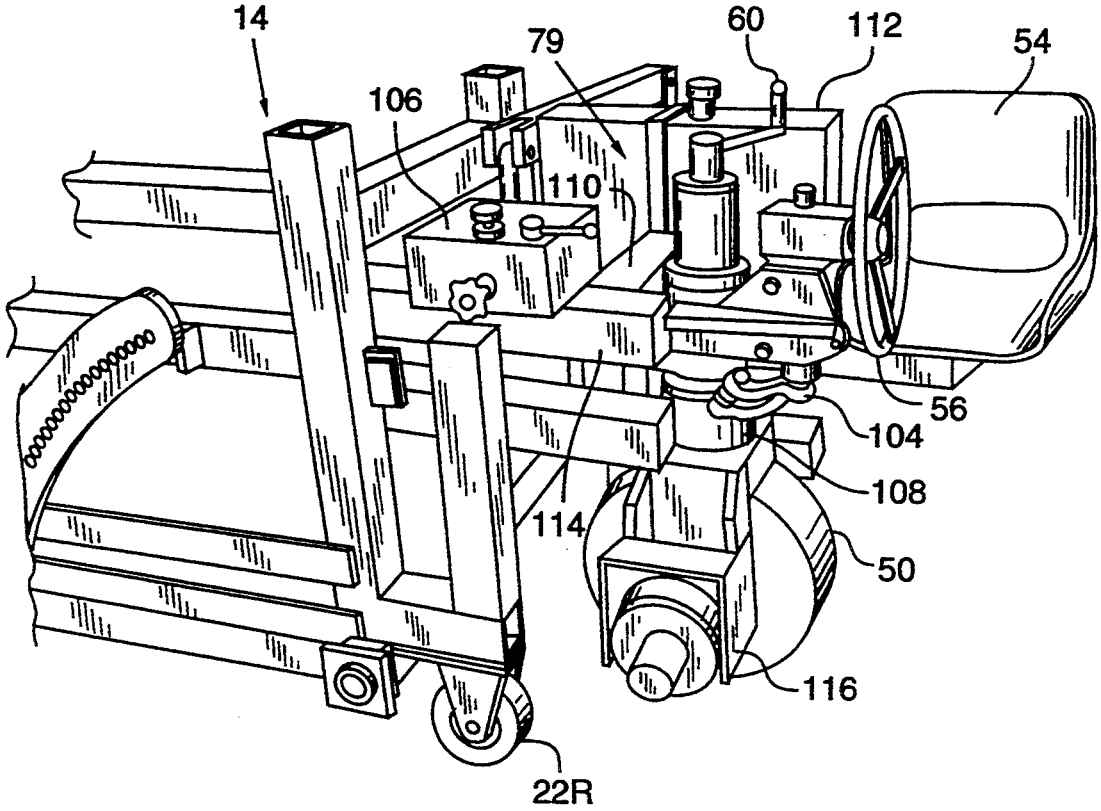
FIG. 7 is an enlarged inboard perspective view of the drive wheel assembly shown in FIG. 2.

FIG. 7 is an enlarged inboard perspective view of the drive wheel assembly 79. The drive wheel assembly includes a cylinder 108 that is coupled by a plate 110 to the back end of frame 14. The plate 110 has a gas tank 112 attached at a first side and horizontal extension member 114 attached at a second side. A hydraulic controller 106 is seated on top of the top extension members 114 and controls a hydraulic drive 116 coupled to drive wheel 50. The steering wheel 56 is pivotally joined by an arm joint 104 to a drive wheel portion of cylinder 108. A crank 60 is coupled at the top end of cylinder 108. A seat 54 is attached to frame 14 and positioned next to steering wheel 56.

The drive wheel 50 is moved up and down vertically by rotating crank 60. As discussed above, when the drive wheel 50 is placed in a lowered position, frame 14 and boom assembly 42 (FIG. 1) can be moved to different locations. The direction at which drive wheel 50 moves frame 14 is controlled by turning steering wheel 56. The steering wheel 56 rotates arm joint 104 and, in turn, changes the direction of drive wheel 50. The direction and speed of rotation of drive wheel 50 are determined by hydraulic drive 116 which in turn is controlled by hydraulic controller 106. Hydraulic drive control is known to those skilled in the art and is, therefore, not explained in detail.

The frame 14 is approximately 36 inches wide, 90 inches long, and approximately 42 inches high and is made out of metal tubing. The entire mobile boom vehicle 12 weighs between 3100–3200 pounds and is rated to carry a 500 pound load in basket 48. However, the mobile boom vehicle 12 can weigh as much as 4,000 pounds depending upon the amount of counter-weight placed inside the metal frame 14. Thus, the system is much lighter than a conventional truck boom that weighs between 60,000–70,000 pounds. In addition, the mobile boom vehicle 12 can operate close to the edge of bridge 72. Therefore, the boom member 38 (FIG. 1) does not have to be as long a conventional truck booms, reducing cost, weight and at the same time increasing stability.

Because of the small size, the mobile boom vehicle 12 can access areas not normally accessible by standard boom trucks. For example, the mobile boom vehicle can be driven on structures that cannot support the weight of a standard boom (e.g., a condemned bridge). If the weight of the mobile boom vehicle is still too heavy to be moved over a given structure, rails can be laid down on top of the structure and the supports wheels 22 driven onto the rails to further distribute weight to a larger area.

In addition, the mobile boom vehicle according to the invention can get to locations that have physical impediments that normally prevents truck boom access. For example, many bridges have a walkway on the outside of the bridge that is typically only used for pedestrian and bicycle traffic. Due to the intended use (i.e., bikes and pedestrians) the sidewalk typically has handrails on either side that are relatively close together (e.g., less than 5 feet apart). Thus, it would not be possible for a truck mounted boom to fit between the two hand rails. The mobile boom vehicle according to the invention, however, by having a narrow width, can fit easily between the two hand rails. Because of the unique way in which the outriggers extend over the top of the frame 14, they can still be extended even within a very confined area. This is not possible with standard outriggers that extend diagonally out from the sides of a truck. Thus, the small physical dimensions allow the mobile boom vehicle to be used in a greater variety of applications (e.g., a sidewalk running along the side of a bridge) than larger boom structures.

A typical operation of the mobile boom vehicle 12 is now described. The mobile boom vehicle 12 is unloaded from a trailer at the location where the work is to be performed. The mobile boom vehicle is driven off the trailer using the drive wheel 50 to the desired work location, for example, on a bridge. If present, the mobile boom vehicle is driven up onto a sidewalk that runs along the side of the bridge. Typically, the mobile boom vehicle is located with the sides of frame 14 parallel with the edge of the structure over which the boom assembly 42 extends. The outriggers are then rotated out from the top of frame 14 and either leaned against an existing vertically aligned support structure on the bridge, for example, a guardrail, or supported by the outrigger legs 26. The novel way in which the outriggers 16 extend out from the top of frame 14 allow additional flexibility as to where the mobile boom vehicle can be operated. For example, by extending out from the top of frame 14, the outriggers can extend over small obstructions, such as a low hand rail, that would prove to be a hinderance for standard outrigger configurations.

After the outriggers are extended out into their support position, the basket 48 is moved into a position where equipment and workmen are loaded. The boom assembly 42 is then extended over the side of bridge 72 to where the work is to be performed. When a task is completed in the present area, the drive wheel 50 moves the frame 14 to a second bridge location. According to the configuration of the bridge, the mobile boom vehicle 12 is maneuvered around obstructions by using steering wheel 56 and crank 60. For example, crank 60 is used to lift the front end of frame 14 off the top of the bridge while steering wheel 56 is then used to steer the mobile boom vehicle along the bridge sidewalk. It is important to note that the load can remain in basket 48 while the mobile boom vehicle is moved to another location.

If the mobile boom vehicle must extend over the side of the sidewalk, for example, to move around a road sign or if the sidewalk is narrower than the width of the mobile crane, then the guide wheels 52 are attached to the side of the frame and extended down an appropriated distance onto the bridge roadway 77. The guide wheels 52 allow frame 14 to remain level while partially extending over the sidewalk curb. After the work is completed on the bridge, the basket 48 is brought back up to the top of the bridge and the remaining load in basket 48 is removed. The outriggers 16 are then retracted onto frame 14 and the guide wheels raised above the bottom of the frame or alternatively removed. The mobile boom vehicle is then reloaded onto the trailer.

Figure 8:
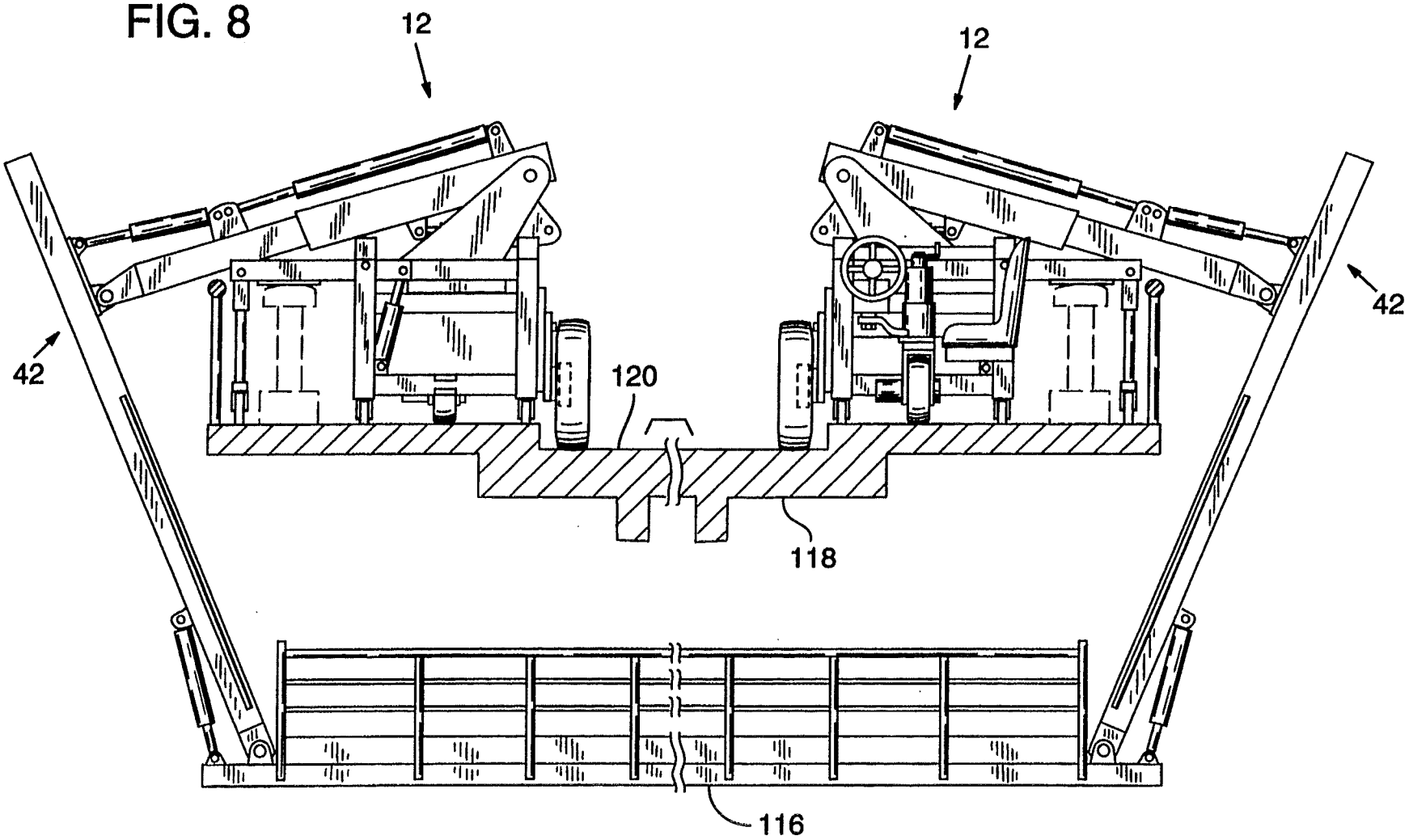
FIG. 8 is an end elevation view of two mobile boom vehicles of the type shown in FIG. 1 supporting a basket underneath a bridge span according to another embodiment of the invention.

FIG. 8 is an end elevation view of two mobile boom vehicles 12, of the type shown in FIG. 1. Each mobile boom vehicle supports an opposite end of a basket 116 underneath a bridge span 118. Each mobile boom vehicle 12 is moved the same distance and in the same direction to keep basket 116 from becoming skewed. If the basket 116 must be moved closer or further away from bridge 116, each boom assembly 42 is lowered or raised the same amount keeping basket 116 in a level position. Since the mobile boom vehicles operate on sidewalks on opposite sides of bridge 118, work can be conducted on the entire under-side of bridge 118 without obstructing traffic on roadway 120.

Having described and illustrated the principles of the invention in a preferred embodiment thereof, it should be apparent that the invention can be modified in arrangement and detail without departing from such principles. I claim all modifications and variation coming within the spirit and scope of the following claims.

1. A mobile boom vehicle for supporting and shifting various equipment and personnel on an elevated structure, comprising:

a frame having a first and second pair of elongate side members joined together by a front and back end by a pair of traverse cross-members that define a frame width;

a platform pivotally joined to a top surface of the frame rotating radially at different angles in a horizontal plane;

at least one outrigger having an elongate arm pivotally joined at a top end of the frame and capable of extending horizontally over and onto the top of a vertically directed guardrail extending up from the elevated structure for providing additional support in holding the frame in an upright position; and a boom assembly coupled to the rotating platform for supporting and shifting the equipment and personnel over an edge and underneath the elevated structure;

the frame sized to a width sufficiently narrow to reside completely within an area defined by an exterior parameter of a sidewalk that extends along a top side of the elevated structure;

the outrigger including a detachable leg pivotally coupled to the elongate arm and extending into a vertical position as the elongate arm extends into a horizontal position thereby holding the elongate arm above the elevated structure and supporting the frame in an upright position.

2. A mobile boom vehicle for supporting and shifting various equipment and personnel on an elevated structure, comprising:

a frame having a first and second pair of elongate side members joined together by a front and back end by a pair of traverse cross-members that define a frame width;

a platform pivotally joined to a top surface of the frame rotating radially at different angles in a horizontal plane;

a boom assembly coupled to the rotating platform for supporting and shifting the equipment and personnel over an edge and underneath the elevated structure;

a steerable drive wheel centered at an end of the frame for controlling which direction the crane moves along the elevated structure wherein the drive wheel is displaced in various vertical positions thereby raising the frame off of the elevated structure and allowing the mobile boom vehicle to be moved according to a corresponding drive wheel direction;

the frame sized to a width sufficiently narrow to reside completely within an area defined by an exterior parameter of a sidewalk that extends along a top side of the elevated structure.

3. A mobile boom vehicle for supporting and shifting various equipment and personnel on an elevated structure, comprising;

a frame having a first and second pair of elongate side members joined together by a front and back end by a pair of traverse cross-members that define a frame width;

a platform pivotally joined to a top surface of the frame rotating radially at different angles in a horizontal plane;

a boom assembly coupled to the rotating platform for supporting and shifting the equipment and personnel over an edge and underneath the elevated structure;

a pair of detachable guide wheels each extendable at various distances down below an inboard side of the frame for holding the boom in a level position when the frame extends over a lower level of the elevated structure, each guide wheel including a guide wheel arm pivotally coupled at a given pivot point to the side of the frame with a bottom end joined to the guide wheel and a top end having a hole that is aligned with any one of a set of holes positioned radially about the associated pivot point, the guide wheel positioned at various distances below the frame by rotating the guide wheel arm about the pivot point until the cylinder aligns with one of said holes;

the frame sized to a width sufficiently narrow to reside completely within an area defined by an exterior parameter of a sidewalk that extends along a top side of the elevated structure.

4. A mobile boom vehicle for supporting and transporting equipment and personnel on a bridge, comprising:

a frame having first and second lateral sides joined together by front, back, top and bottom sides forming an inner frame cavity;

a rotating platform attached to the top side of the frame capable of being rotated radially around a vertical axis;

a boom assembly coupled to the rotating platform for supporting and shifting the equipment and personnel out on a lateral side and below the bridge; and a pair of outriggers having elongate arms pivotally coupled to the frame and extendable out over the top side of the frame onto the top of a support member thereby supporting the frame in an upright position;

wherein the support member is a leg that is hinged to the end of the arm, the leg extending out into a substantially vertical position as the arm rotates downward into a horizontal position.

* * * * *